US008862021B2

(12) United States Patent
Deguchi et al.

(10) Patent No.: US 8,862,021 B2
(45) Date of Patent: Oct. 14, 2014

(54) TRANSPORTABLE IMAGE FORMING APPARATUS

(75) Inventors: Masanobu Deguchi, Osaka (JP); Shinji Kawamura, Osaka (JP); Takahiro Kitano, Osaka (JP); Wataru Yoshida, Osaka (JP); Hideki Sekino, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 154 days.

(21) Appl. No.: 13/695,571

(22) PCT Filed: Apr. 5, 2011

(86) PCT No.: PCT/JP2011/058610
§ 371 (c)(1),
(2), (4) Date: Oct. 31, 2012

(87) PCT Pub. No.: WO2011/135983
PCT Pub. Date: Nov. 3, 2011

(65) Prior Publication Data

US 2013/0045024 A1 Feb. 21, 2013

(30) Foreign Application Priority Data

Apr. 30, 2010 (JP) ..... 2010-104894

(51) Int. Cl.
*G03G 15/00* (2006.01)
*G03G 21/16* (2006.01)

(52) U.S. Cl.
CPC .. *G03G 21/1604* (2013.01); *G03G 2215/00004* (2013.01); *G03G 2221/1681* (2013.01)
USPC ..... 399/108

(58) Field of Classification Search
USPC ..... 399/108
See application file for complete search history.

(56) References Cited

U.S. PATENT DOCUMENTS 4,456,362 A * 6/1984 Masaki et al. ..... 399/108
4,789,876 A 12/1988 Miyai et al.

(Continued)

FOREIGN PATENT DOCUMENTS

JP 62-87977 4/1987
JP 63-123759 5/1988

(Continued)

OTHER PUBLICATIONS

International Search Report for PCT/JP2011/058610, mailed May 10, 2011.

*Primary Examiner* — David Bolduc
(74) *Attorney, Agent, or Firm* — Nixon & Vanderhye, P.C.

(57) ABSTRACT

In the state where a handle (2) and a lid (12) are attached to a main body (11), left and right bases (22) of the handle (2) are fitted into recesses (1112, 1113) at coupling portions (111, 112). Left and right shaft supports (91) of the lid (12) are fitted into recesses (1111, 1114). Shaft portions (81) of the left and right bases (22) are fitted from above into a through hole (72) and a through hole (73), respectively, and are supported rotatably about a center axis (200) in the through holes (72, 73). Shafts (93 to 95) of the shaft supports (91, 92) are laterally fitted into through holes (71, 74, 75), respectively, and are supported rotatably about the center axis (200) in the through holes (71, 74, 75). The shaft (94) of the shaft support (92) is laterally fitted into a blind hole (82) of the right base (22).

7 Claims, 7 Drawing Sheets

(56) References Cited

U.S. PATENT DOCUMENTS

| | | | | |
|---|---|---|---|---|
| 4,910,551 | A * | 3/1990 | Onoda et al. | 399/9 |
| 4,951,090 | A * | 8/1990 | Matsumoto et al. | 399/13 |
| 5,344,248 | A | 9/1994 | Schoon et al. | |
| 2006/0083564 | A1* | 4/2006 | Yazawa et al. | 399/363 |
| 2011/0064456 | A1* | 3/2011 | Tada et al. | 399/107 |

FOREIGN PATENT DOCUMENTS

| | | |
|---|---|---|
| JP | 63-88631 | 6/1988 |
| JP | 63-267955 | 11/1988 |
| JP | 4-128772 | 4/1992 |
| JP | 4-226378 | 8/1992 |
| JP | 4-365729 | 12/1992 |

* cited by examiner

TRANSPORTABLE IMAGE FORMING APPARATUS

This application is the U.S. national phase of International Application No. PCT/JP2011/058610 filed 5 Apr. 2011 which designated the U.S. and claims priority to JP Patent Application No. 2010-104894 filed 30 Apr. 2010, the entire contents of each of which are hereby incorporated by reference.

TECHNICAL FIELD

The present invention relates to transportable image forming apparatuses such as a printer and a copy machine, including a case made up of a plurality of parts supported mutually rotatably, the transportable image forming apparatus being provided with a handle for grasping.

BACKGROUND ART

Relatively compact-size transportable image forming apparatuses, which are often for personal use, are placed on a desk or the like when used only and are stored beside a side face of the desk or the like when not used. In general, transportable image forming apparatuses have a smaller dimension in height relative to the width and the depth, and such transportable image forming apparatuses are often stored bringing a side face of the apparatus into contact with a horizontal plane such as a floor so that the upper face and the bottom face of the apparatus become vertical. Transportable image forming apparatuses are further provided with a handle for grasping on one side face in order to facilitate the transportation between the storage position and the usage position. Since such a handle is grasped only during transportation of a transportable imaging forming apparatus, the handle is configured to be retractable so as not to become an obstacle to user's operations during use.

Especially an imaging forming apparatus with a copy function is provided with a rotatable document cover so as to open/close a document platen at a top face of the case. In such a transportable imaging forming apparatus equipped with a copy function, unless the rotation of the document cover is limited when the apparatus is made vertical for storage and transportation, the document cover may be broken because it interferes with user's body, a desk or the like. Even a transportable image forming apparatus not equipped with a copy function may include a case made up of a plurality of separate parts that are mutually rotatable with consideration given to the maintenability, and includes a sheet feeding tray and a sheet output tray that are allowed to be exposed from the case when used. With this configuration, when the case of the apparatus is made vertical for storage or transportation and if one part of the case is rotated about the other part or the sheet feeding tray or the sheet output tray is rotated about the case, a similar problem will occur.

To cope with such problems of the transportable image forming apparatuses, an apparatus configured to limit the movement of a document cover operatively in association with a handle operation (see Patent Literature 1, for example), an apparatus configured to let a sheet output tray stored operatively in association with a change of the posture of a case due to a handle operation (see Patent Literature 2, for example) and an apparatus configured to limit the movement of a document cover by a sheet output tray (see Patent Literature 3, for example) are conventionally proposed, for example.

CITATION LIST

Patent Literature

Patent Literature 1: Japanese Patent Application Laid-Open No. 04 (1992)-128772

Patent Literature 2: Japanese Patent Application Laid-Open No. 63 (1988)-123759

Patent Literature 3: Japanese Patent Application Laid-Open No. 63 (1988)-267955

SUMMARY OF INVENTION

Technical Problem

For conventional transportable image forming apparatuses, however, detailed consideration about how to attach a handle, which is movably disposed between a grasp position and a retraction position, to a case made up of a plurality of mutually rotatable parts is not provided and such apparatuses unfortunately fail to simplify the structure sufficiently.

It is an object of the present invention to provide a transportable image forming apparatus including a case made up of a plurality of mutually rotatable parts and a handle movably disposed between a grasp position and a retraction position, the apparatus being capable of simplifying the structure sufficiently by attaching the handle to the case in a correct state.

Solution to Problem

A transportable image forming apparatus of the resent invention includes a case and a handle. The case accommodates an image forming portion and includes a plurality of parts including a first part and a second part that are attached to be mutually rotatable within a predetermined range at a coupling portion on one end side of each of the first part and the second part. The handle includes a base having a first end and a second end, the first end including a shaft portion and the second end from which a grasp portion extends. The handle is rotatable between an exposure position where the grasp portion is away from a side face of the case on a side of the coupling portion of the first part and the second part and a retraction position where the grasp portion is close to the side face.

In the case, the first part includes, on a side of the coupling portion to the second part, a first shaft bearing configured to rotatably support the shaft portion of the handle, and the first shaft bearing includes an opening through which the shaft portion passes in a direction orthogonal to an axial direction of the shaft portion. The second part includes, on a side of the coupling portion to the first part, a limiting member configured to limit displacement of a central axis position of the shaft portion with reference to a central axis position of the first shaft bearing over entire of the predetermined range when the second part is attached to the first part.

In this configuration, preferably the base includes a blind hole at the first end, the blind hole being provided coaxially with the shaft portion, and the limiting member includes a shaft to be fitted into the blind hole so as to be coaxial with the shaft portion. During the attachment of the second part to the first part, the limiting member is fitted into the blind hole of the base, whereby displacement of the central axis position of the shaft portion with reference to the central axis position of the first shaft bearing can be easily and securely limited.

Preferably the second part includes, on the side of the coupling portion to the first part, a shaft support extending toward the first part, the first part includes, on the side of the coupling portion to the second part, a second shaft bearing configured to pivotally support the shaft support, the second shaft bearing being coaxial with the first shaft bearing, and the shaft extends coaxially from the shaft support. The handle and the second part attached to the first part have their rotational axes that are coaxially located, whereby the configuration to support the handle and the second part rotatably can be simplified.

During image formation processing, in a state where a face of the first part orthogonal to a side face on the side of the coupling portion to the second part becomes horizontal, the first part holds swingably a tray to store sheets at the side face on the side of the coupling portion to the second part, and the grasp portion at the retraction position comes into contact with a bottom face of the tray swinging to a predetermined angle. Since the contact of the tray bottom face to the grasp portion allows the tray to be fixedly supported at the retraction position, the configuration just for fixing the tray at the retraction position can be eliminated.

Preferably at the exposure position, the base is orthogonal to a side face of the first part on the side of the coupling portion to the second part, and the transportable image forming apparatus includes a member configured to limit movement of the base from the retraction position at the exposure position. An operator is allowed to grasp the grasp portion of the handle in the state of vertically extending from the side face of the case and forming a sufficient space with the side face of the case.

Preferably the first part includes, on a side face on the side of the coupling portion to the second part, a connector portion for a power supply plug and a power supply switch. Since the connector portion and the power supply switch are located at the side face that pivotally supports the handle, the connector portion and the power supply switch are exposed upwardly in the handle-grasped state, and operations of connecting a power cord and switching-on can be easily performed.

Preferably the second part accommodates an image reading portion provided with a document platen at a side face of the second part orthogonal to a side face thereof on the side of the coupling portion to the first part, and the second part includes a document cover configured to selectively open and close the document platen, the document cover being rotatably supported on the side of the coupling portion to the first part. The rotating support of the document cover essential to the image reading portion is disposed at the case on the side face side that pivotally supports the handle, and in the handle-grasped state, the rotation of the document cover in the direction to open the document platen can be prevented.

DESCRIPTION OF EMBODIMENTS

The following describes a transportable image forming apparatus 10 according to one embodiment of the present invention, with reference to the drawings. The transportable image forming apparatus includes an image reading portion that reads an image on a document and an image forming portion that forms an image on a sheet, and so is equipped with an image formation processing function to copy an image on a document to a sheet.

Figure 1A:
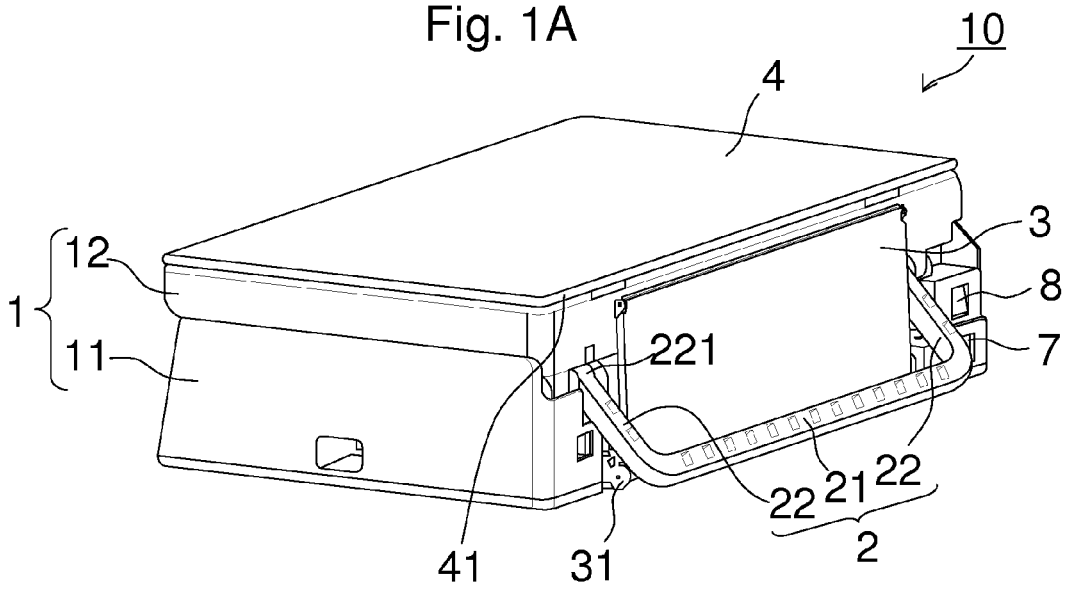
FIGS. 1A and B are external views of a transportable image forming apparatus according to one embodiment of the present invention, viewed from the rear-face direction and the front-face direction, respectively.

As illustrated in FIG. 1A, the transportable image forming apparatus 10 includes a handle 2 and a sheet output tray 3 on a rear face of a case 1, and includes a document cover 4 on a top face of the case 1. The case 1 is configured as two parts including a main body 11 as a first part and a lid 12 as a second part. The main body 11 accommodates the image reading portion that performs electrophotographic image forming processing, for example. The lid 12 accommodates the image reading portion.

The handle 2 includes a grasp portion 21 to be grasped during transportation of the transportable image forming apparatus 10 and bases 22, 22 bending from both ends of the grasp portion 21 at right angles for extension. The bases 22 each have an open end 221 as a first end that is rotatably supported at the rear face of the case 1. The sheet output tray 3 has a lower end 31 that is rotatably supported at the rear face of the case 1, and stores sheets to be fed to the image forming portion. The document cover 4 has a rear-face side end 41 that is rotatably supported on the rear-face side of the case 1 so as to cover the top face of the case 1 openablly/closably.

The width of the sheet output tray 3 is set shorter than the space between the internal side faces of the left and right bases 22 of the handle 2. The left and right bases 22 are positioned externally in the width direction of the sheet output tray 3.

The main body 11 further includes a power code outlet 7 and a power supply switch 8 on the rear face thereof.

During image formation processing, the transportable image forming apparatus 10 is placed on a desk, for example, while letting the top face of the case 1 horizontal, while during transportation letting the rear face of the case 1 upward by grasping the handle 2. During storage, the transportable image forming apparatus 10 may be placed letting the top face or the rear face of the case 1 upward depending on the storage space.

Figure 1B:
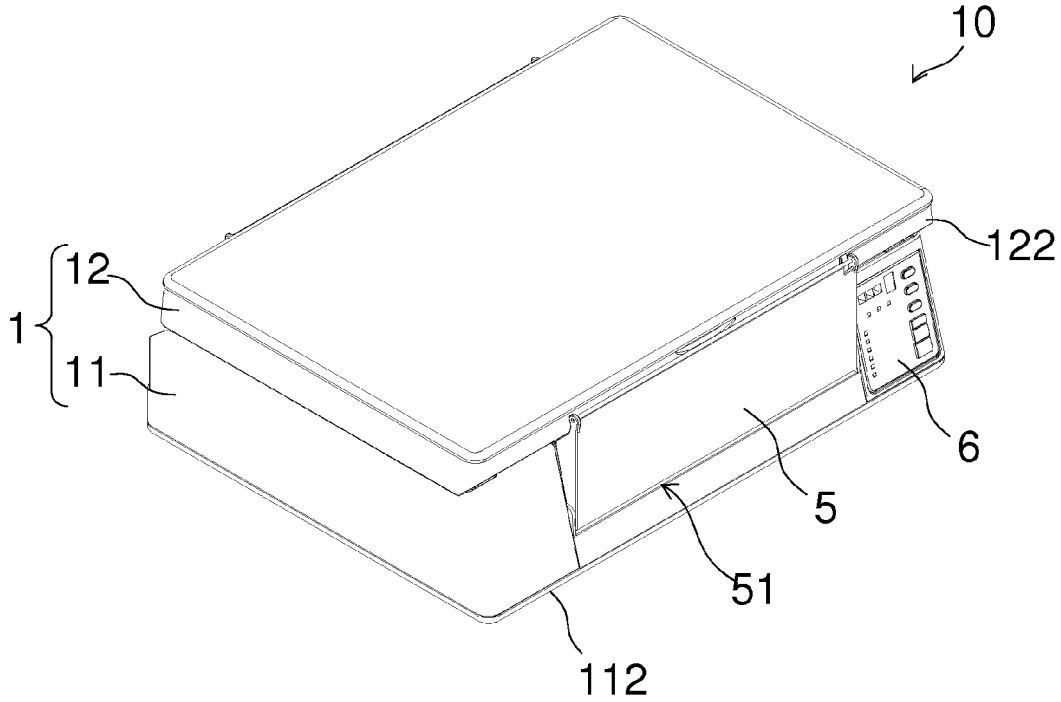

As illustrated in FIG. 1B, the transportable image forming apparatus 10 includes a sheet feeding tray 5 and an operation panel 6 on a front face of the case 1. The sheet feeding tray 5 has a lower end 51 that is supported rotatably at the front face of the case 1, and stores sheets subjected to the image forming processing by the image forming portion. The operation panel 6 accepts various input operations of image forming processing conditions such as density setting, copy quantity setting and magnification setting.

A line connecting a lower end 112 of the main body 11 and a front face 122 of the lid 12 on the front-face side of the case 1 is at right angles to the bottom face of the main body 11 and the top face of the lid 12. The transportable image forming apparatus 10 can be placed on a floor during transportation and storage while letting the front face of the case 1 downward, horizontal and stand still.

Figure 2:
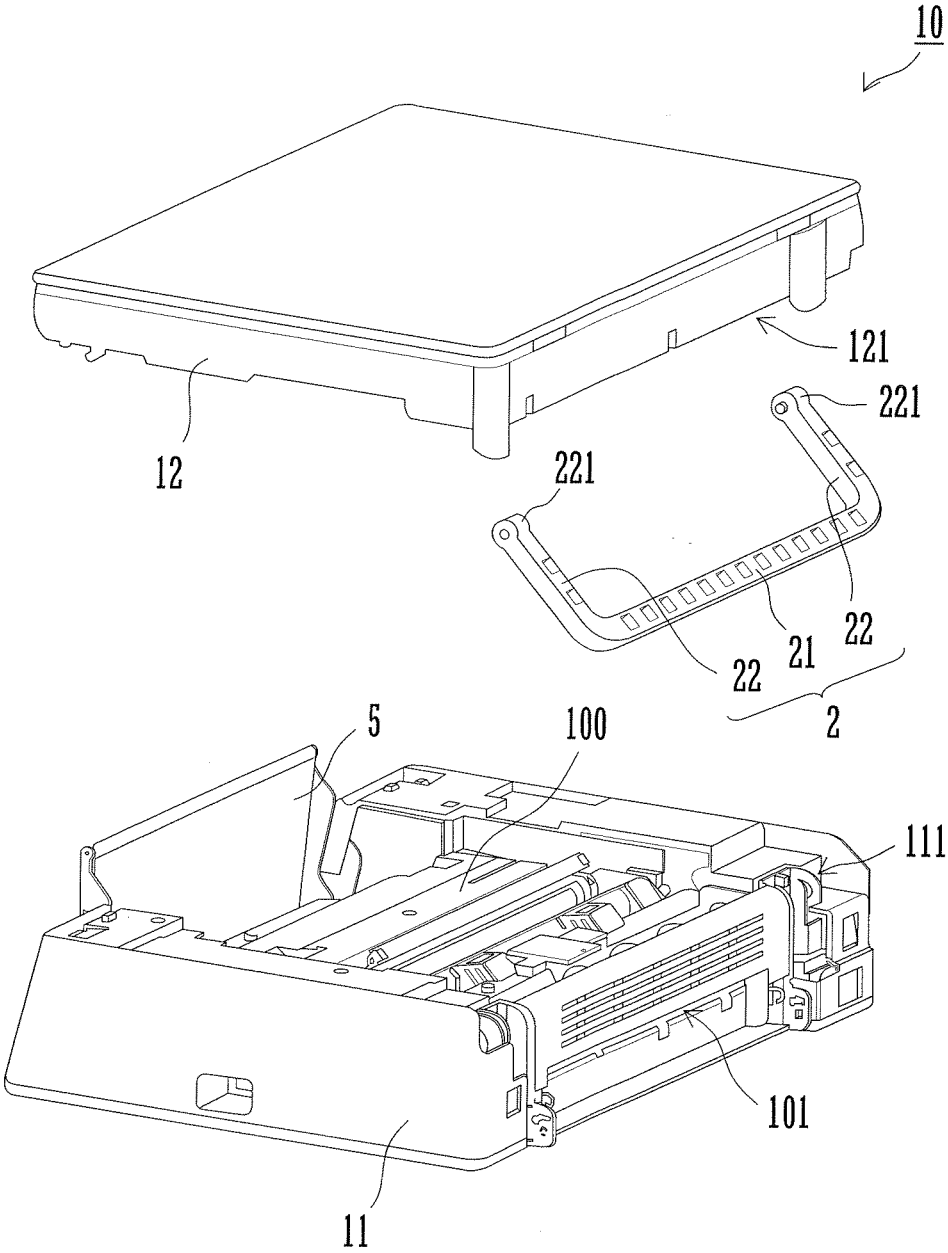
FIG. 2 is an exploded view of the transportable image forming apparatus, from which a sheet feeding tray is omitted.

As illustrated in FIG. 2, the main body 11 includes a hollow box that is open at the front face, the rear face and the top face, and accommodates an image forming portion 100 inside. The image forming portion 100 performs electrophotographic image forming processing as one example. To this end, the image forming portion 100 is provided with a photoreceptor drum, a charger, a developing unit, a transfer unit, a fixing unit and the like. The inside of the main body 11 is formed a sheet conveyance path extending from the sheet feeding tray 5 on the front face to an output exit 101 on the rear face via between the photoreceptor drum and the transfer unit inside the image forming portion 100.

Considering convenience for maintenance operations and paper jam removing operations of the image forming portion 100, the main body 11 and the lid 12 are mutually rotatably supported at coupling portions 111 and 121 on the rear-face side. In the state where the main body 11 is placed with the bottom face kept horizontal, when the lid 12 is rotated so that the front-face side of the lid 12 moves upward, then the top face of the main body 11 is allowed to open, so that the image forming portion 100 becomes exposed. To the coupling portions 111 and 121 are rotatably supported the open ends of the bases 22 of the handle 2.

Note here that the case 1 is equipped with lock mechanism not illustrated. The lock mechanism selectively fixes the coupling state between the lid 12 and the main body 11 in the state where the bottom face of the main body 11 and the top face of the lid 12 become horizontal.

Figure 3:
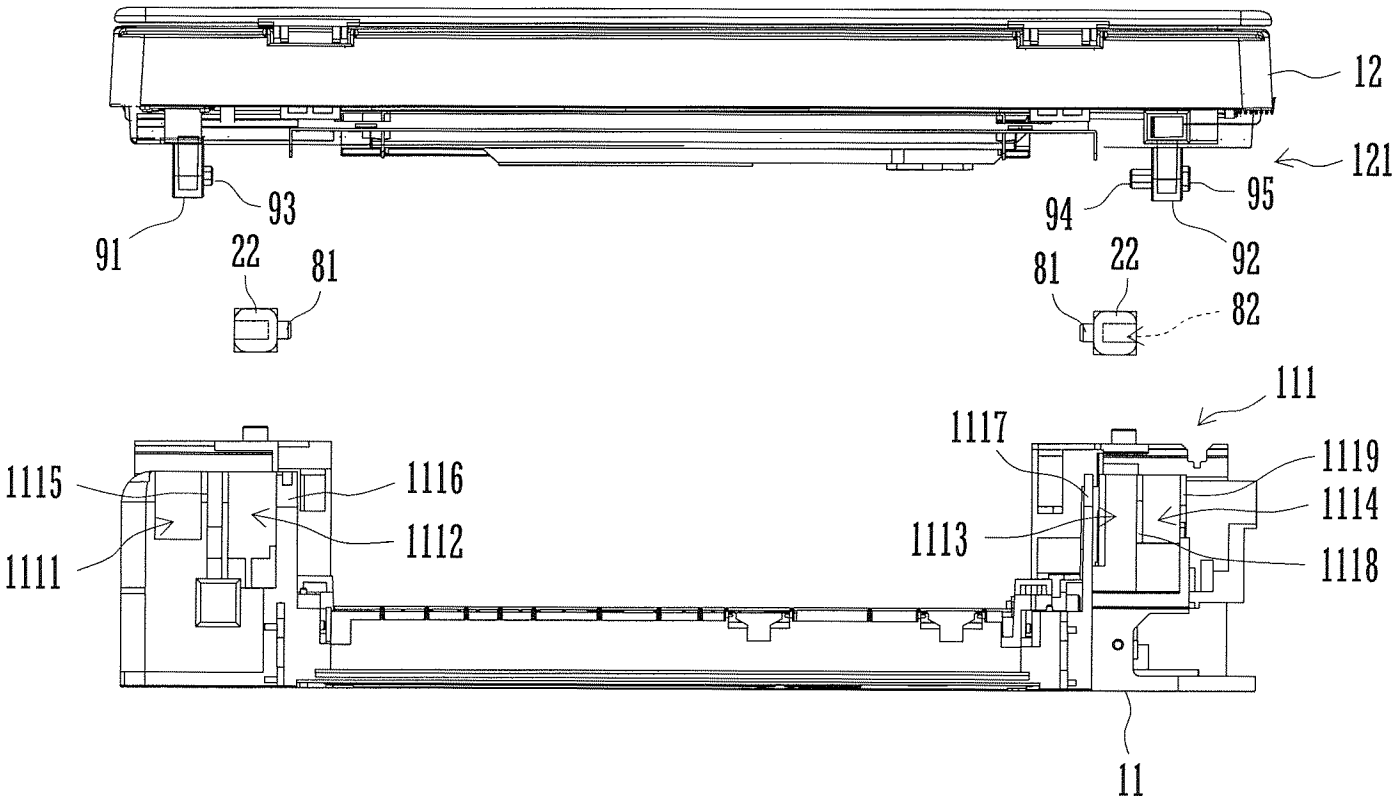
FIG. 3 is an exploded view of the transportable image forming apparatus viewed from the rear face thereof.
Figure 4:
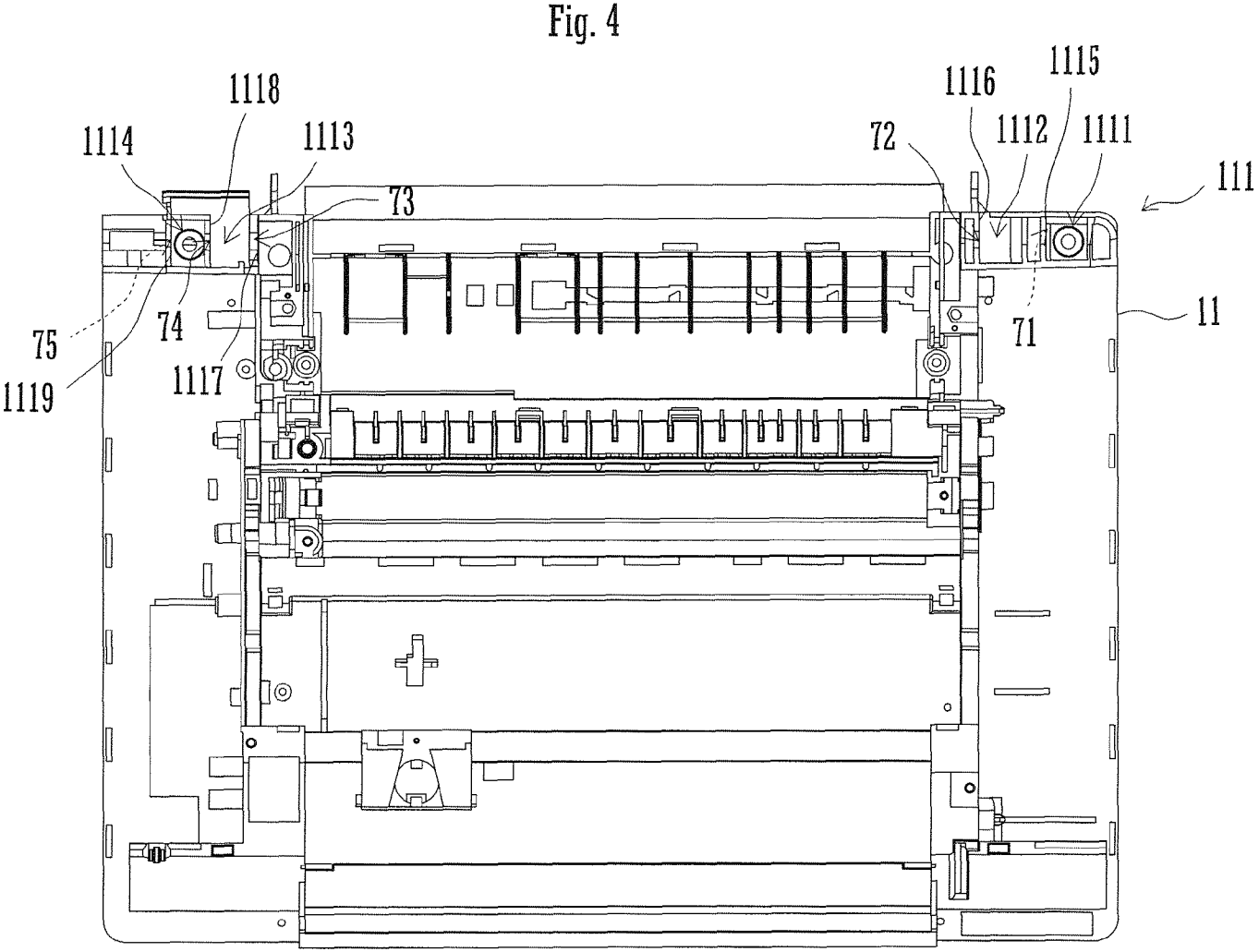
FIG. 4 is a plan view of a main body of the transportable image forming apparatus.

As illustrated in FIGS. 3 and 4, the coupling portion 111 of the main body 11 is formed with recesses 1111 to 1114 that are open to the top face and the rear face. At a partition wall 1115 between the recess 1111 and the recess 1112 is formed a through hole 71. At a partition wall 1116 of the recess 1112 on the recess 1113 side is formed a through hole 72. Ata partition wall 1117 of the recess 1113 on the recess 1112 side is formed a through hole 73. At a partition wall 1118 between the recess 1113 and the recess 1114 is formed a through hole 74. At a partition wall 1119 of the recess 1114 on the opposite side of the partition wall 1118 is formed a through hole 75. The through hole 72 and the through hole 73 correspond to a first shaft bearing of the present invention, and the through hole 71, the through hole 74 and the through hole 75 correspond to a second shaft bearing of the present invention.

At the left and right bases 22 of the handle 2 protrude shaft portions 81 from their internal side faces so as to be opposed to each other. At at least right base 22 is formed a blind hole 82 coaxially with the shaft portion 81 at the outer face.

The coupling portion 121 of the lid 12 includes a shaft support 91 and a shaft support 92 extending from two positions of the bottom face toward the main body 11 located downward. The shaft support 91 on the left side is provided with a shaft 93 extending from the inner face. The shaft support 92 on the right side is provided with a shaft 94 extending from the inner face and a shaft 95 extending from the outer face, the shaft 94 and the shaft 95 being provided coaxially.

Figure 5:
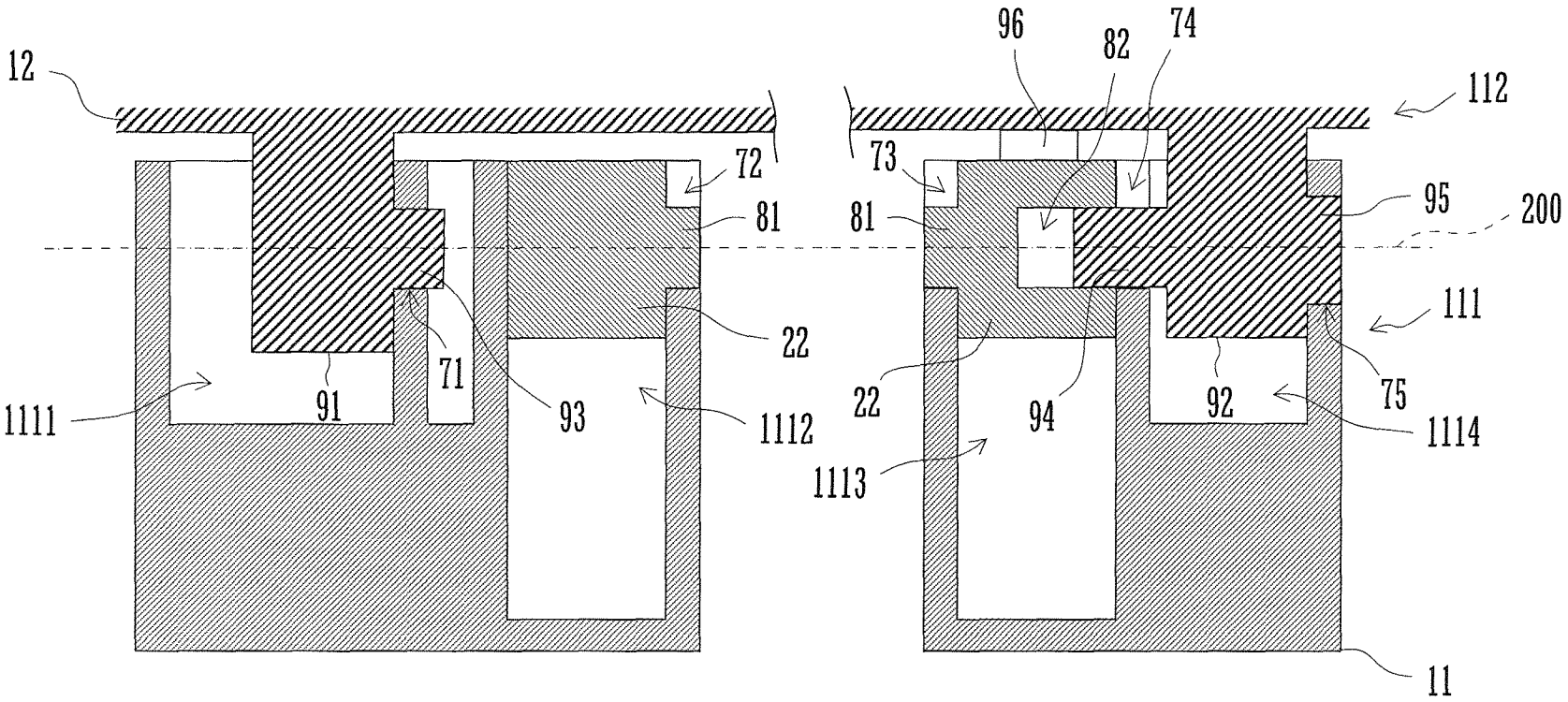
FIG. 5 is a cross-sectional view of a coupling portion of a case of the transportable image forming apparatus.

As illustrated in FIG. 5, when the handle 2 and the lid 12 are attached to the main body 11, the left and right bases 22 of the handle 2 are fitted into the recess 1112 and the recess 1113, respectively, at the coupling portions 111 and 121. Then, the left and right shaft supports 91 and 92 of the lid 12 are fitted into the recess 1111 and the recess 1114, respectively.

At this time, the shaft portions 81 of the left and right bases 22 are fitted from above into the through hole 72 and the through hole 73, respectively, and they are supported rotatably about a center axis 200 in the through hole 72 and the through hole 73. The shafts 93 to 95 of the shaft supports 91 and 92 are inserted laterally into the through hole 71, the through hole 74 and the through hole 75, respectively, and they are supported rotatably about the center axis 200 in the through hole 71, the through hole 74 and the through hole 75, respectively. The shaft 94 of the shaft support 92 is further fitted laterally into the blind hole 82 of the right base 22. The shaft portions 81 and the shafts 93 to 95 are arranged coaxially on the center axis 200.

Since the shaft 93, the shaft 94 and the shaft 95 are rotatably supported in the through hole 71, the through hole 74 and the through hole 75, the lid 12 is attached rotatably to the main body 11. Since the left and right shaft portion 81 of the handle 2 are supported rotatably in the through hole 72 and the through hole 73, and the shaft 94 is fitted into the blind hole 82, the handle 2 is attached rotatably to the main body 11 and the lid 12. Especially since the shaft 94 is fitted into the blind hole 82, displacement of the central axis position of the right base 22 from the center axis 200 in the recess 1113 can be limited.

During assembly, the shaft 94 of the shaft support 92 of the lid 12 is fitted into the blind hole 82 of the base 22 of the handle 2. Thereafter the shaft support 91 of the lid 12 is firstly fitted from above into the recess 1111 while fitting the shaft 93 into the through hole 71, and then the left and right bases 22 of the handle 2 and the shaft support 92 are fitted into the recesses 1112 to 1114, respectively, while fitting the left and right shaft portions 81 into the through holes 72 and 73, respectively, and fitting the shafts 94 and 95 into the through holes 74 and 75, respectively. Thereby there is no need to provide a member only for supporting the handle 2 rotatably, thus simplifying the configuration.

Note that, when a separate member of the lid 12 can limit the movement of the left and right bases 22 fitted into the recesses 1112 and 1113 in the direction orthogonal to the axial direction, there is no need to arrange the shaft portion 81 and the shafts 93 to 95 coaxially on the center axis 200.

The coupling portion 121 of the lid 12 is formed with a protrusion 96 extending downward. The protrusion 96 comes into contact with the top face of the right base 22 at least when the lid 12 covers the top face of the main body 11. The protrusion 96 limits the upward movement of the base 22 beyond the horizontal face when the bottom face of the main body 11 and the top face of the lid 12 are kept horizontal. Further since the bottom faces of the bases 22 come into contact with the bottom face of the recess 1112 and the bottom face of the recess 1113, the downward movement range of the bases 22 is limited when the bottom face of the main body 11 and the top face of the lid 12 are in a horizontal state.

Figure 6A:
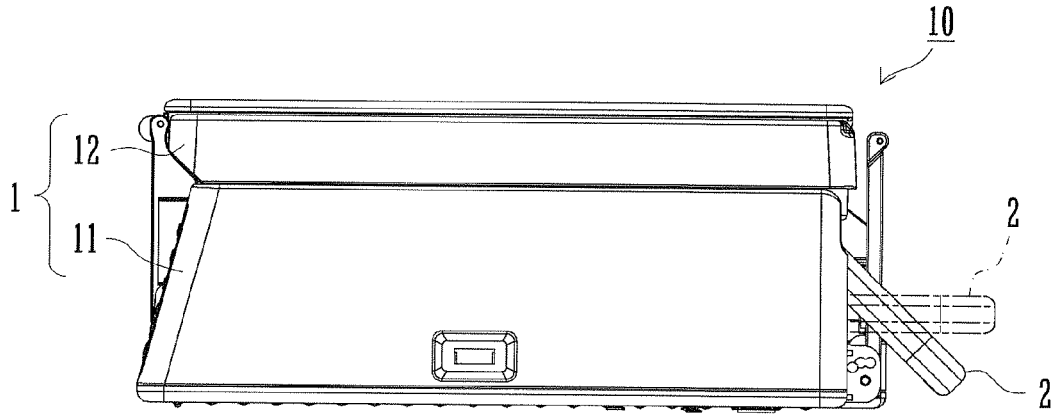
FIGS. 6A and B are side views of the transportable image forming apparatus when used.
Figure 6B:
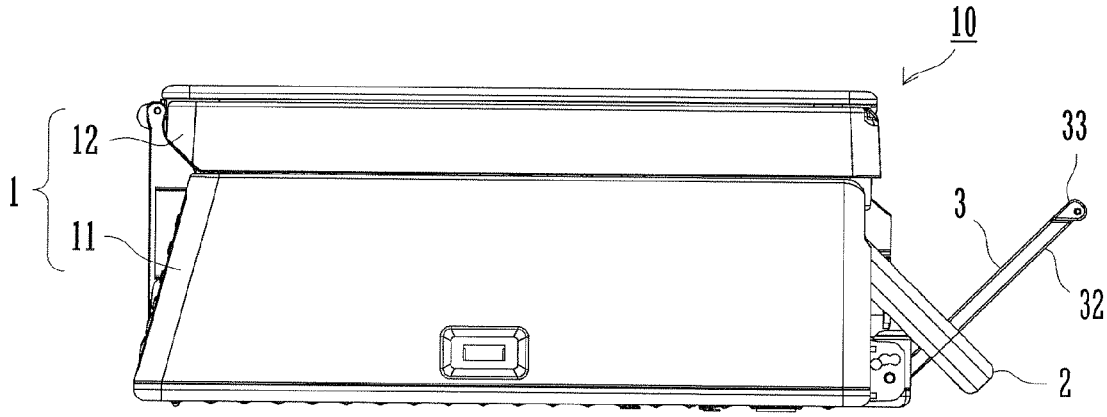

Thereby, the handle 2 is swingable between a retraction position indicated with solid lines in FIG. 6A and an exposure position indicated with alternate long and two short dashes lines in the drawing. The grasp portion 21 of the handle 2 is away from the rear face of the case 1 at the exposure position and becomes closer to the rear face of the case 1 at the retraction position. When the transportable image forming apparatus 10 is used, as illustrated in FIG. 6B, the transportable image forming apparatus 10 is placed with the bottom face of the main body 11 and the top face of the lid 12 kept horizontal. When the handle 2 is located at the retraction position, as the sheet output tray 3 is allowed to swing so that the upper end 33 thereof is away from the rear faces of the main body 11 and the lid 12, then a bottom face 32 of the sheet output tray 3 comes into contact with the inner face of the grasp portion 21 of the handle 2 to stop the swing of the sheet output tray 3. Since the position of the sheet output tray 3 when used can be defined by the contact with the grasp portion 21, a member for fixing the sheet output tray 3 at the position when used can be omitted.

Figure 7:
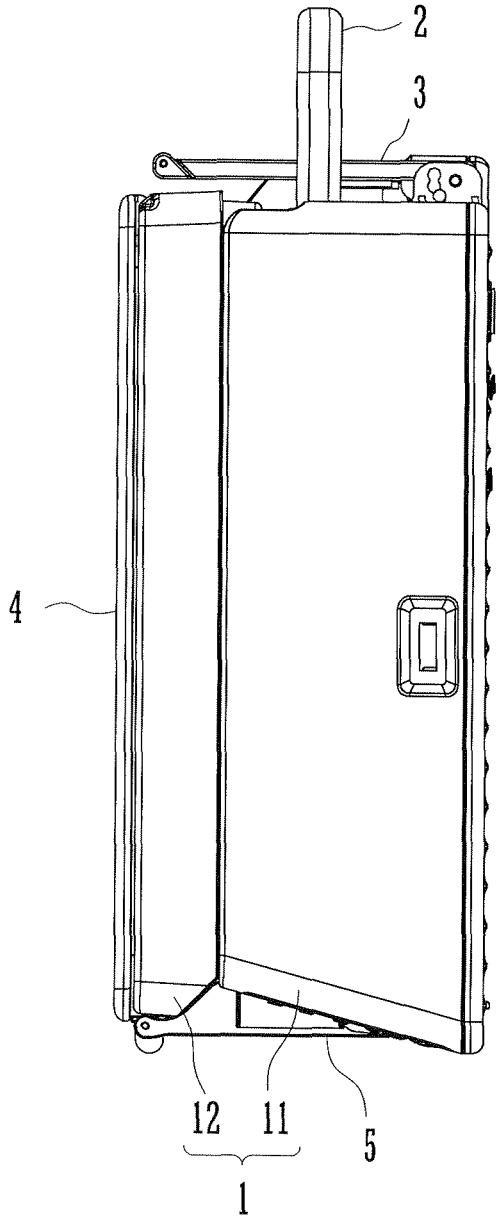
FIG. 7 is a side view of the transportable image forming apparatus when no used.

As illustrated in FIG. 7, during transportation of the transportable image forming apparatus 10, the rear faces of the main body 11 and the lid 12 are directed upward and the handle 2 is positioned at the exposure position. In this state, the rotating support of the lid 12 about the main body 11 and the rotating support of the document cover 4 about the lid 12 are located at upper parts of the transportable image forming apparatus 10. The lid 12 and the document cover 4 are biased toward the direction closing the top face of the main body 11 and the top face of the lid 12, respectively, due to their own weights. Therefore during transportation of the transportable image forming apparatus 10, the lid 12 and the document cover 4 do not move to the directions becoming away from the main body 11 and the lid 12, respectively, thereby preventing breakage by interfering with the body of an operator, a desk or the like.

Herein, lock means is provided to selectively fix the sheet feeding tray 5 at a position where the lower end of thereof comes into contact with the front face of the main body 11. Another lock means may be provided to selectively limit the movement of the document cover 4 when the document cover 4 covers the top face of the lid 12.

As illustrated in FIG. 7, when the rear faces of the main body 11 and the lid 12 are kept upward and horizontal, a line connecting the front end of the bottom face of the main body 11 and the front face of the lid 12 becomes substantially horizontal. Bringing the front end of the bottom face of the main body 11 and the front face of the lid 12 into contact with a floor or the like enables the storage of the transportable image forming apparatus 10 in a lengthwise direction.

Since the front face of the main body 11 has a slanting face so that the upper end is inclined toward the rear-face side, the operation panel 6 does not come into contact with the floor or the like even when the transportable image forming apparatus 10 is stored in a lengthwise direction. Further when the transportable image forming apparatus 10 is placed in a lengthwise direction, then the rear face of the main body 11 is directed upward and the power code outlet 7 and the power supply switch 8 are exposed upwardly. This configuration facilitates connection of a power supply and switching-on of the power supply prior to the operation of the transportable image forming apparatus 10.

Considering the balance during transportation by grasping the handle 2, the pivotal-support position of the bases 22 in the direction parallel to the rear faces of the main body 11 and the lid 12 has to be decided so that the weight of the transportable image forming apparatus 10 can be substantially uniformly allocated across the handle in this direction.

Although the present embodiment is configured so that the shaft 94 of the shaft support 92 is inserted into only the blind hole 82 of the right base 22 of the handle 2, the blind hole 82 may be formed at the left base 22 of the handle 2 as well so that the shaft 93 of the shaft support 91 of the lid 12 can be fitted therein. Considering the ease of assembly, however, preferably the shaft support 93 or the shaft support 94 is fitted into the blind hole 82 of only one of the bases 22 of the handle 2.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

REFERENCE SIGNS LIST

1 Case
2 Handle
3 Sheet output tray
4 Document cover
5 Sheet feeding tray
6 Operation panel
7 Power code outlet
8 Power supply switch
10 Transportable image forming apparatus
11 Main body
12 Lid
21 Grasp portion
22 Base
111, 121 Coupling portions

The invention claimed is:

1. A transportable image forming apparatus, comprising: a case accommodating an image forming portion, the case including a plurality of parts including a first part and a second part that are attached to be mutually rotatable within a predetermined range at a coupling portion on one end side of each of the first part and the second part; and a handle including a base having a first end and a second end, the first end including a shaft portion and the second end from which a grasp portion extends, wherein the handle is provided swingably between an exposure position where the grasp portion is away from a side face of the case on a side of the coupling portion of the first part and the second part and a retraction position where the grasp portion is close to the side face, wherein the first part includes, on a side of the coupling portion to the second part, a first shaft bearing configured to rotatably support the shaft portion, the first shaft bearing including an opening through which the shaft portion passes in a direction orthogonal to an axial direction of the shaft portion, and the second part includes, on a side of the coupling portion to the first part, a limiting member configured to limit displacement of a central axis position of the shaft portion with reference to a central axis position of the first shaft bearing over entire of the predetermined range when the second part is attached to the first part.

2. The transportable image forming apparatus according to claim 1, wherein the base includes a blind hole at the first end, the blind hole being provided coaxially with the shaft portion, and the limiting member comprises a shaft to be fitted into the blind hole so as to be coaxial with the shaft portion.

3. The transportable image forming apparatus according to claim 2, wherein the second part includes, on the side of the coupling portion to the first part, a shaft support extending toward the first part, the first part includes, on the side of the coupling portion to the second part, a second shaft bearing configured to pivotally support the shaft support, the second shaft bearing being coaxial with the first shaft bearing, and the shaft extends coaxially from the shaft support.

4. The transportable image forming apparatus according to claim 1, wherein during image formation processing by the image forming portion in a state where a face of the first part orthogonal to a side face on the side of the coupling portion to the second part becomes horizontal, the first part holds swingably a tray to store sheets to be processed by the image formation processing at the side face on the side of the coupling portion to the second part, and the grasp portion at the retraction position comes into contact with a bottom face of the tray swinging to a predetermined angle.

5. The transportable image forming apparatus according to claim 1, wherein the exposure position is at a position where the base is orthogonal to a side face of the first part on the side of the coupling portion to the second part, and the transportable image forming apparatus comprises a member configured to limit movement of the base from the retraction position at the exposure position.

6. The transportable image forming apparatus according to claim 1, wherein the first part includes, on a side face on the side of the coupling portion to the second part, a power code outlet and a power supply switch.

7. The transportable image forming apparatus according to claim 1, wherein the second part accommodates an image reading portion provided with a document platen at a side face of the second part orthogonal to a side face thereof on the side of the coupling portion to the first part, and the second part includes a document cover configured to selectively open and close the document platen, the document cover being rotatably supported on the side of the coupling portion to the first part.

* * * * *